US009897965B2

(12) United States Patent
Yawada et al.

(10) Patent No.: US 9,897,965 B2
(45) Date of Patent: Feb. 20, 2018

(54) IMAGE FORMING DEVICE HAVING A SUCTION DEVICE

(71) Applicant: FUJI XEROX CO., LTD., Tokyo (JP)

(72) Inventors: Teppei Yawada, Kanagawa (JP); Manabu Furuki, Kanagawa (JP); Masahiro Uchida, Kanagawa (JP); Masashi Ikeda, Kanagawa (JP); Makoto Kamisaki, Kanagawa (JP); Tatsuhiro Igarashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/230,845

(22) Filed: Aug. 8, 2016

(65) Prior Publication Data

US 2017/0248895 A1 Aug. 31, 2017

(30) Foreign Application Priority Data

Feb. 25, 2016 (JP) ..... 2016-034792

(51) Int. Cl.
*G03G 21/00* (2006.01)

(52) U.S. Cl.
CPC ..... *G03G 21/0011* (2013.01); *G03G 21/0052* (2013.01); *G03G 2221/001* (2013.01); *G03G 2221/0094* (2013.01)

(58) Field of Classification Search
CPC ..... G03G 2221/1627; G03G 21/0011
See application file for complete search history.

(56) References Cited

U.S. PATENT DOCUMENTS

2006/0141378 A1* 6/2006 Takada ..... G03G 5/0525 430/59.6
2012/0063814 A1* 3/2012 Otome ..... G03G 15/0822 399/258

FOREIGN PATENT DOCUMENTS

JP 11212417 A * 8/1999
JP 2008-275724 A 11/2008
JP 2008-276141 A 11/2008

OTHER PUBLICATIONS

JP_2008276141_A_T MachineTranslation Naruse, 2008, Japan.*
JP_11212417_A_T MachineTranslation, 1999, Kanda, Japan.*

* cited by examiner

*Primary Examiner* — Clayton E Laballe
(74) *Attorney, Agent, or Firm* — Oliff PLC

(57) ABSTRACT

An image forming device includes an image carrier, a charging device that charges the surface of the image carrier, an electrostatic image forming device that forms an electrostatic image on the surface of the image carrier, a developing device that uses a developer containing toner particles and external additives adhering to the surface of the toner particle to develop the electrostatic image into a toner image, a transfer device that transfers the toner image to a recording medium, a cleaning device having a blade that cleans off residual toner from the image carrier, a suction device that suctions all or part of residual toner excepting the external additives released from the surface of the toner particles, and a fixing device that fixes the toner image to the recording medium.

8 Claims, 4 Drawing Sheets

IMAGE FORMING DEVICE HAVING A SUCTION DEVICE

CROSS-REFERENCE TO RELATED APPLICATIONS

This application is based on and claims priority under 35 USC 119 from Japanese Patent Application No. 2016-034792 filed Feb. 25, 2016.

BACKGROUND

Technical Field

The present invention relates to an image forming device.

SUMMARY

According to an aspect of the invention, there is provided an image forming device including: an image carrier; a charging device that charges a surface of the image carrier; an electrostatic image forming device that forms an electrostatic image on the surface of the image carrier; a developing device that includes electrostatic image developer including toner that contains toner particles and external additives adhering to a surface of the toner particle, and uses the electrostatic image developer to develop the electrostatic image formed on the surface of the image carrier into a toner image; a transfer device that transfers the toner image formed on the surface of the image carrier onto a surface of a recording medium; a cleaning device having a blade that contacts the surface of the image carrier and cleans off residual toner; a suction device, located upstream of the cleaning device in a rotational direction of the image carrier, that suctions all or part of residual toner excepting the external additives released from the surface of the toner particles; and a fixing device that fixes the toner image transferred to the surface of the recording medium.

BRIEF DESCRIPTION OF THE DRAWINGS

An exemplary embodiment of the present invention will be described in detail based on the following figures, wherein.

DETAILED DESCRIPTION

Figure 1:
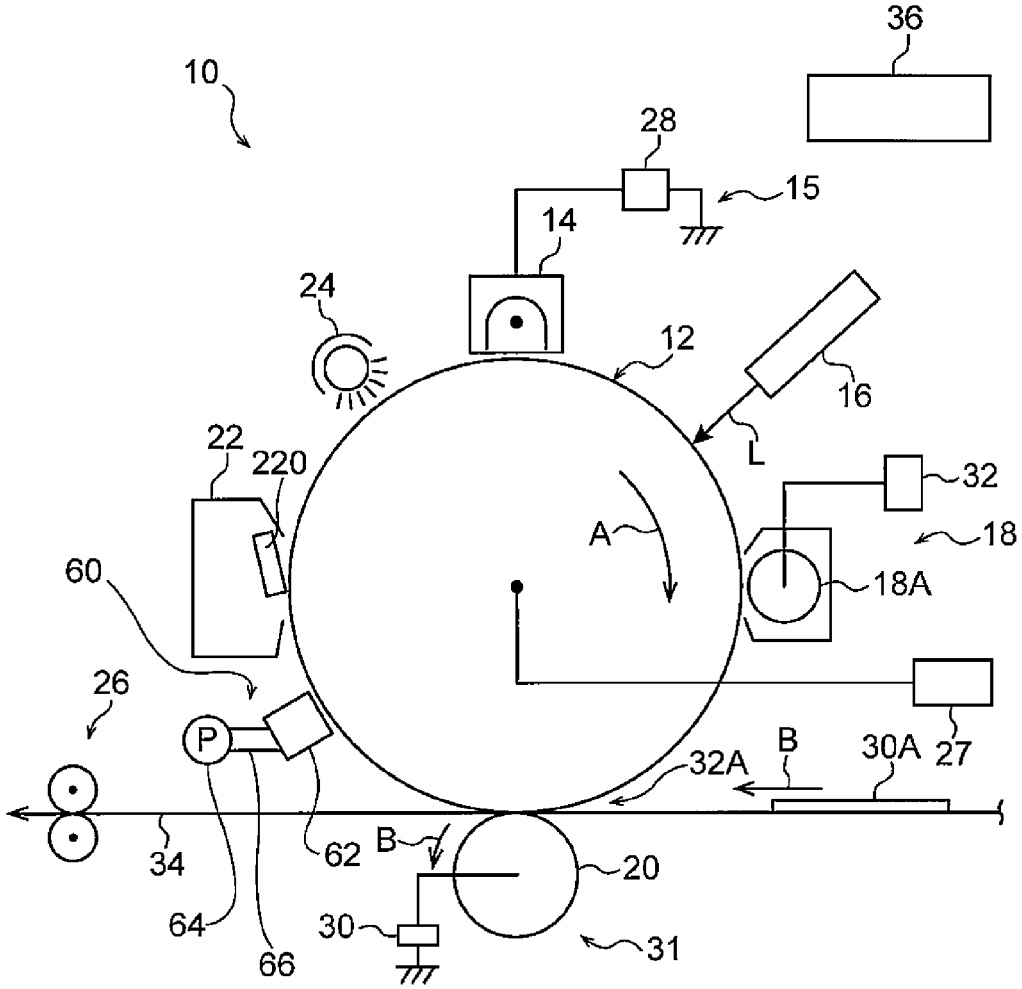
FIG. 1 is a schematic configuration diagram illustrating an example of an image forming device according to an exemplary embodiment.

Hereinafter, an exemplary embodiment of the present invention will be described in detail.

An image forming device according to the present exemplary embodiment is equipped with: an image carrier; a charging device that charges the surface of the image carrier; an electrostatic image forming device that forms an electrostatic image on the charged surface of the image carrier; a developing device that includes electrostatic image developer (hereinafter also referred to as "developer") including toner that contains toner particles and external additives adhering to the surface of the toner particle, and uses the developer to develop the electrostatic image formed on the surface of the image carrier into a toner image; a transfer device that transfers the toner image formed on the surface of the image carrier onto the surface of a recording medium; a cleaning device having a blade that contacts the surface of the image carrier and cleans off residual toner; a suction device, located upstream of the cleaning device in the rotational direction of the image carrier, that suctions all or part of the residual toner excepting the external additives released from the surface of the toner particles; and a fixing device that fixes the toner image transferred to the surface of the recording medium.

Herein, some of the external additives adhering (added) to the surface of the toner particle are released from the toner particles by mechanical load due to mixing in the developing device and scraping at the cleaning part. When the released external additives reach the area of contact between the blade of the cleaning device and the image carrier (hereinafter also called the cleaning part), the external additives are held in check at the front edge of the cleaning part (the part on the downstream side of the area of contact between the blade and the image carrier in the rotational direction), and an agglomeration (hereinafter also called an "additive dam") is formed by the pressure from the blade. This additive dam contributes to the improvement of cleaning performance.

On the other hand, if images are output repeatedly, wear on the blade occurs. Additionally, toner may slip through sometimes from the worn areas of the blade. Furthermore, if toner slips through, development in which toner adheres to the surface of the image carrier and forms a film (hereinafter called "toner filming") may occur.

In contrast, in an image forming device according to the present exemplary embodiment, the suction device is provided upstream of the cleaning device in the rotational direction of the image carrier, and the suction device suctions all or part of the residual toner excepting the external additives released from the surface of the toner particles. In other words, after the toner image is transferred from the surface of the image carrier, but before the residual toner is cleaned by the blade, the external additives released from the toner particles are made to remain on the surface of the image carrier, while the toner particles with the external additives adhering to the surface are suctioned, thereby fully removing or partially removing these toner particles from the surface of the image carrier, and decreasing the residual amount.

For this reason, the residual toner amount (the amount of toner particles) arriving at the cleaning part may be moderated. Consequently, even if the blade becomes worn, the slipping through of toner from the worn areas of the blade is itself moderated. On the other hand, the external additives released from the toner particles arrive at the cleaning part and contribute to the formation of an additive dam, thereby ensuring cleaning performance.

From the above, in an image forming device according to the present exemplary embodiment, the slipping through of toner from the worn areas of the blade is moderated. In addition, toner filming caused by such slipping through of toner is also moderated.

On the other hand, in the image forming device according to the present exemplary embodiment, if the amount of external additives released from the toner particles is small, and the toner particles with the external additives adhering to the surface thereof are suctioned, the amount of external additives arriving at the cleaning part may decrease in some cases. If the amount of external additives decreases, the magnitude of the additive dam also decreases, and cleaning performance may decrease in some cases. In this case, to minimize decreases in cleaning performance, toner particles with the external additives adhering to the surface thereof may be made to arrive at the cleaning part to an extent that the slipping through of toner is still moderated, the external additives may be released from the toner particles by mechanical load due to scraping at the cleaning part or the like, and the magnitude of the additive dam may be increased.

Accordingly, the image forming device according to the present exemplary embodiment additionally may be equipped with a control device that controls the suction device based on the area coverage of the toner image, and starts or stops the suction of residual toner by the suction device. With this control device, when the area coverage of the toner image is high and the slipping through of toner occurs more readily (when the area coverage is equal to or greater than a predetermined value), residual toner is suctioned by the suction device, for example. On the other hand, when the area coverage is low and the slipping through of toner occurs less readily (when the area coverage is less than a predetermined value), the suction of residual toner by the suction device is stopped. Consequently, when the suction of residual toner by the suction device is stopped, the amount of toner particles with the external additives adhering to the surface thereof arriving at the cleaning part, or in other words, the magnitude of the additive dam, may be increased. For this reason, decreases in cleaning performance are moderated, while in addition, the slipping through of toner from the worn areas of the blade is moderated.

Additionally, the image forming device according to the present exemplary embodiment additionally may be equipped with a control device that controls the suction device based on the area coverage of the toner image, and changes the suction pressure of the suction device. With this control device, when the area coverage of the toner image is high and the slipping through of toner occurs more readily (when the area coverage is equal to or greater than a predetermined value), the suction pressure of the suction device is raised, and the amount of suction of toner particles with adhering external additives is increased, for example. On the other hand, when the area coverage is low and the slipping through of toner occurs less readily (when the area coverage is less than a predetermined value), the suction pressure of the suction device is lowered, and the amount of suction of toner particles with adhering external additives is decreased. Consequently, the amount of toner particles with the external additives adhering to the surface thereof arriving at the cleaning part, or in other words, the magnitude of the additive dam, is ensured. For this reason, decreases in cleaning performance are moderated, while in addition, the slipping through of toner from the worn areas of the blade is moderated.

The image forming device according to the present exemplary embodiment is applicable to commonly known image forming devices, such as: a device of the direct-transfer type that transfers a toner image formed on the surface of the image carrier directly onto the recording medium; a device of the intermediate-transfer type that performs a first transfer of a toner image formed on the surface of the image carrier onto an intermediate transfer body, and performs a second transfer of the toner image transferred onto the surface of the intermediate transfer body to the surface of the recording medium; and a device equipped with a charge neutralizing device that, after the transfer of the toner image, radiates a charge neutralizing light onto the surface of the image carrier to neutralize the image carrier before charging.

In the case of a device of the intermediate-transfer type, the configuration applied to the transfer device includes, for example, an intermediate transfer body on whose surface a toner image is transferred, a first transfer device that performs the first transfer of the toner image formed on the surface of the image carrier onto the surface of the intermediate transfer body, and a second transfer device that performs the second transfer of the toner image transferred onto the surface of the intermediate transfer body to the surface of the recording medium.

Note that in the image forming device according to the present exemplary embodiment, a portion that at least includes the image carrier, for example, may have a cartridge structure (process cartridge) that is inserted into or removed from the image forming device.

Hereinafter, an example of the image forming device according to the present exemplary embodiment will be illustrated, but the present exemplary embodiment is not limited to the following example. Herein, the major parts illustrated in the drawings will be described, while the description of other parts may be reduced or omitted.

FIG. 1 is a schematic configuration diagram illustrating an example of an image forming device according to the exemplary embodiment.

As illustrated in FIG. 1, the image forming device 10 according to the present exemplary embodiment is provided with an electrophotographic photoreceptor (an example of an image carrier; hereinafter called the "photoreceptor") 12, for example. The photoreceptor 12 is cylindrical, jointed to a drive unit 27 such as a motor via a drive force transmission member (not illustrated) such as a gear, and is rotationally driven by the drive unit 27 around a rotary axis indicated by the black dot. In the example illustrated in FIG. 1, the photoreceptor 12 is rotationally driven in the direction of the arrow A.

Around the photoreceptor 12, a charging device 15, a latent image forming device 16, a developing device 18, a transfer device 31, a suction device 60, a cleaning device 22, and a charge neutralizing device 24 are disposed in order along the rotational direction of the photoreceptor 12, for example. Additionally, a fixing device 26 is also disposed in the image forming device 10. The image forming device 10 also includes a control device 36 that controls the operations of each device (each component).

The image forming device 10 may also be treated as a process cartridge at least integrated with the photoreceptor 12. The process cartridge may also be a process cartridge integrated with other devices.

Hereinafter, each device (each component) of the image forming device 10 will be described in detail.

(Photoreceptor)

The photoreceptor 12 includes a conductive substrate, an undercoat layer formed on top of the conductive substrate, and a photosensitive layer formed on top of the undercoat layer, for example. The photosensitive layer may have a two-layer structure of a charge-producing layer and a charge-transporting layer. The photosensitive layer may be an organic photosensitive layer or an inorganic photosensitive layer. The photoreceptor 12 may also be provided with a protective layer on top of the photosensitive layer.

(Charging Device)

The charging device 15 charges the surface of the photoreceptor 12. For example, the charging device 15 is provided in contact or in non-contact with the surface of the photoreceptor 12, and is equipped with a charging member 14 that charges the surface of the photoreceptor 12, and a power source 28 that applies a charging voltage to the charging member 14 (an example of a voltage application unit for the charging member). The power source 28 is electrically connected to the charging member 14.

The charging member 14 of the charging device 15 may be a contact charger using a component such as a conductive charging roller, charging brush, charging film, charging rubber blade, or charging tube, for example. Additionally, the charging member 14 may also be a commonly known charger such as a non-contact roller charger, or a scorotron charger or corotron charger utilizing corona discharge, for example.

The charging device 15 (including the power source 28) is electrically connected to the control device 36 provided in the image forming device 10, is driven under control by the control device 36, and applies a charging voltage to the charging member 14, for example. The charging member 14 applied with a charging voltage from the power source 28 causes the photoreceptor 12 to be charged to a charge potential corresponding to the applied charging voltage. For this reason, by adjusting the charging voltage applied from the power source 28, the photoreceptor 12 is charged to different charge potentials.

(Latent Image Forming Device)

The latent image forming device 16 forms an electrostatic latent image on the charged surface of the photoreceptor 12. Specifically, for example, the latent image forming device 16 is electrically connected to the control device 36 provided in the image forming device 10, is driven under control by the control device 36, radiates a light L modulated based on image information of the image to be formed on the surface of the photoreceptor 12 charged by the charging member 14, and forms an electrostatic latent image corresponding to the image of the image information on the photoreceptor 12.

The latent image forming device 16 may be optical equipment having a light source that exposes light image-wise, such as semiconductor laser light, LED light, or liquid crystal shutter light, for example.

(Developing Device)

The developing device 18 is provided downstream from the position where the light L is radiated by the latent image forming device 16 in the rotational direction of the photoreceptor 12, for example. Inside the developing device 18, a housing unit that contains developer is provided. In the housing unit, electrostatic image developer including toner is contained. The toner is contained in a charged state inside the developing device 18, for example.

The developing device 18 is equipped with a developing member 18A that uses developer including toner to develop the electrostatic latent image formed on the surface of the photoreceptor 12, and a power source 32 that applies a developing voltage to the developing member 18A. The developing member 18A is electrically connected to the power source 32, for example.

The developing member 18A of the developing device 18 is selected according to the type of developer, but may be a developing roller including a developing sleeve with a built-in magnet, for example.

The developing device 18 (including the power source 32) is electrically connected to the control device 36 provided in the image forming device 10, is driven under control by the control device 36, and applies a developing voltage to the developing member 18A, for example. The developing member 18A applied with a developing voltage is charged at a developing potential corresponding to the developing voltage. Additionally, the developing member 18A charged at a developing potential holds developer contained inside the developing device 18 on the surface of the developing member 18A, and supplies toner included in the developer from inside the developing device 18 to the surface of the photoreceptor 12.

The toner supplied onto the photoreceptor 12 adheres by electrostatic power to the electrostatic image on the photoreceptor 12, for example. Specifically, for example, the toner included in the developer is supplied to the areas where the electrostatic image is formed on the photoreceptor 12 due to the potential difference in the areas where the photoreceptor 12 and the developing member 18A face each other, or in other words, the potential difference between the electric potential on the surface of the photoreceptor 12 and the developing potential of the developing member 18A in the relevant areas. Note that if a carrier is included in the developer, the carrier remains held by the developing member 18A and returns inside the developing device 18.

For example, the electrostatic latent image on the photoreceptor 12 is developed by the toner supplied from the developing member 18A, and a toner image corresponding to the electrostatic latent image is formed on the photoreceptor 12. In addition, the amount of developer per unit area is from 2.0 g/m$^2$ to 8.0 g/m$^2$, for example.

The developer contained in the developing device 18 will now be described.

The developer includes toner, which includes toner particles and external additives adhering to the surface of the toner particles. The developer may be one-component developer including toner only, or two-component developer including toner and carrier.

Toner particles manufactured by commonly known manufacturing processes, such as dry manufacturing processes (such as kneading and crushing, for example) or wet manufacturing processes (such as agglomeration and coalescence, suspension polymerization, and molten suspension, for example) may be applied as the toner particles.

As for the volume mean diameter (D50v) of the toner particles, a range from 2 μm to 10 μm is preferable, from 3 μm to 8 μm is more preferable, and from 3 μm to 5 μm is even more preferable. If the toner particles are reduced in diameter, the slipping through of toner from worn areas of the blade 220 occurs more readily, but in the image forming device 10, such slipping through of toner is moderated more easily.

Note that various mean diameters and various particle size distribution indices of the toner particles are measured using the COULTER MULTISIZER II (manufactured by Beckman Coulter), and for the electrolytic solution, ISOTON II (manufactured by Beckman Coulter) is used.

During measurement, from 0.5 mg to 50 mg of the measurement sample is added to 2 mL of a 5% aqueous solution of a surface-active agent (preferably sodium alkylbenzene sulfonate) as a dispersant. This solution is added to a volume from 100 ml to 150 ml of electrolytic solution.

The electrolytic solution containing the suspension of the sample is subjected to a dispersion process for one minute in an ultrasonic dispersion device, and the COULTER MULTISIZER II is used to measure the particle size distribution of particles with diameters ranging from 2 μm to 60 μm by using an aperture of 100 μm as the aperture diameter. Note that the number of sampled particles is 50,000.

From particle size ranges (channels) separated based on the measured particle size distribution, cumulative distributions of volume and number are drawn in order from small diameter, in which the particle diameters at cumulative 16% are defined to be the volume diameter D16v and the number diameter D16p, the particle diameters at cumulative 50% are defined to be the volume mean diameter D50v and the cumulative number mean diameter D50p, and the particle diameters at cumulative 84% are defined to be the volume diameter D84v and the number diameter D84p.

Using the above values, a volume mean particle size distribution index (GSDv) is computed as $(D84v/D16v)^{1/2}$, while a number mean particle size distribution index (GSDp) is computed as $(D84p/D16p)^{1/2}$.

The mean degree of circularity of the toner particles is preferably from 0.95 to 1.00, and more preferably from 0.98 to 1.00. As the toner particles become more spherically shaped, the slipping through of toner from worn areas of the blade 220 occurs more readily, but in the image forming device 10, such slipping through of toner is moderated more easily.

The degree of circularity of the toner particles is obtained by observing original particles of the toner particles with an SEM device, and from planar image analysis of obtained images of the original particles, the degree of circularity is obtained as "100/SF2" computed according to the formula:

$$\text{Circularity}(100/SF2)=4\pi\times(A/I^2)$$

where I represents the boundary length of an original particle in an image, and A represents the projected area of the original particle.

Additionally, the mean degree of circularity of the toner particles is obtained as the 50% degree of circularity in the cumulative frequency of the degree of circularity for 100 original particles obtained by the above planar image analysis.

The external additives may be inorganic particles, for example. Such inorganic particles may be $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO—$SiO_2$, $K_2O$—$(TiO_2)n$, $Al_2O_3$-$2SiO_2$, $CaCO_3$, $MgCO_3$, $BaSO_4$, or $MgSO_4$, for example. Among these, silica particles are preferable as the external additives.

The surface of the inorganic particles used as the external additives may be subjected to a hydrophobic treatment. The hydrophobic treatment is performed by immersing the inorganic particles in a hydrophobic treatment agent, for example. The hydrophobic treatment agent is not particularly limited, but may be an agent such as a silane coupling agent, silicone oil, a titanate coupling agent, or an aluminum coupling agent, for example. One of these agents may be used alone, or two or more of these agents may be used.

Regarding the amount of hydrophobic treatment agent, ordinarily, from 1 part by mass to 10 parts by mass of the hydrophobic treatment agent is used for 100 parts by mass of the inorganic particles, for example.

The volume mean diameter of the external additives is preferably from 10 nm to 300 nm, more preferably from 20 nm to 200 nm, and even more preferably from 20 nm to 120 nm. If the volume mean diameter of the external additives is set to the above range, the external additives are released suitably from the toner particles inside the developing device 18, and even if residual toner (toner particles with adhering external additives) on the surface of the photoreceptor 12 are suctioned by the suction device 60, a suitable amount of external additives are made to remain on the surface of the photoreceptor 12, and the magnitude of the additive dam is ensured more easily. For this reason, the magnitude of the additive dam is ensured more easily, decreases in cleaning performance are moderated, while in addition, the slipping through of toner from the worn areas of the blade 220 is moderated more easily.

The volume mean diameter of the external additives is measured by observing 500 original particles of the external additives after adding (dispersing) the external additives to the toner particles with a scanning electron microscope (SEM) at 40,000× magnification, measuring the longest diameter and the shortest diameter for each particle by image analysis of the original particles, and measuring the sphere-equivalent diameter from the median value. The 50% diameter of the cumulative frequency of the obtained sphere-equivalent diameters (D50v) is taken to be the mean diameter of the external additives (that is, the volume mean diameter).

The contained amount (added amount) of external additives is preferably from 0.5 parts by mass to 8 parts by mass to 100 parts by mass of toner particles, and more preferably from 2 parts by mass to 6 parts by mass. If the contained amount of the external additives is set to the above range, the external additives are released suitably from the toner particles inside the developing device 18, and even if residual toner (toner particles with adhering external additives) on the surface of the photoreceptor 12 are suctioned by the suction device 60, a suitable amount of external additives are made to remain on the surface of the photoreceptor 12, and the magnitude of the additive dam is ensured more easily. For this reason, the magnitude of the additive dam is ensured more easily, decreases in cleaning performance are moderated, while in addition, the slipping through of toner from the worn areas of the blade 220 is moderated more easily.

(Transfer Device)

The transfer device 31 is provided downstream from the position where the developing member 18A is disposed in the rotational direction of the photoreceptor 12, for example. The transfer device 31 is equipped with a transfer member 20 that transfers the toner image formed on the surface of the photoreceptor 12 to a recording medium 30A, and a power source 30 that applies a transfer voltage to the transfer member 20. The transfer member 20 is cylindrically shaped, for example, and transports the recording medium 30A caught between the transfer member 20 and the photoreceptor 12. The transfer member 20 is electrically connected to the power source 30, for example.

The transfer member 20 of the transfer device 31 may be a contact transfer charger using a component such as a belt, roller, film, or rubber blade, or a commonly known non-contact transfer charger, such as a scorotron transfer charger or a corotron transfer charger utilizing corona discharge, for example.

The transfer device 31 (including the power source 30) is electrically connected to the control device 36 provided in the image forming device 10, is driven under control by the control device 36, and applies a transfer voltage to the transfer member 20, for example. The transfer member 20 applied with a transfer voltage is charged at a transfer potential corresponding to the transfer voltage.

When a transfer voltage of opposite polarity from the toner constituting the toner image formed on the photoreceptor 12 is applied to the transfer member 20 from the power source 30 of the transfer member 20, in the area where the photoreceptor 12 and the transfer member 20 face each other (see the transfer area 32A in FIG. 1), a transfer electric field is formed with an electric field strength that acts to move the toner constituting the toner image on the photoreceptor 12 from the photoreceptor 12 to the transfer member 20 by electrostatic force.

The recording medium 30A is housed in a housing omitted from illustration, transported from this housing along a transport path 34 by multiple transport members omitted from illustration, and arrives at the transfer area 32A, which is the area where the photoreceptor 12 and the transfer member 20 face each other. In the example illustrated in FIG. 1, the recording medium 30A is transported in the direction of the arrow B. The toner image on the photoreceptor 12 is transferred onto the recording medium 30A arriving at the transfer area 32A by the transfer electric field formed in the area as a result of the transfer voltage being applied to the transfer member 20, for example. In other words, the movement of toner from the surface of the photoreceptor 12 to the recording medium 30A causes the toner image to be transferred onto the recording medium 30A, for example.

The toner image on the photoreceptor 12 is transferred onto the recording medium 30A by the transfer electric field. The size of the transfer electric field is controlled based on a transfer current value. The transfer current value is a current value detected by the transfer device 31 when the transfer electric field is applied by constant current control. The transfer current value expresses the size of the transfer electric field. For example, the transfer current value is from 10 μA to 45 μA.

(Suction Device)

The suction device 60 is provided downstream from the transfer area 32A in the rotational direction of the photoreceptor 12, and upstream from the cleaning device 22 in the rotational direction of the photoreceptor 12.

The suction device 60 is equipped with a box-shaped suction unit 62 including a rectangular suction port extending in the axial direction of the photoreceptor 12, a suction pump 64, and a duct 66 that joins the suction unit 62 and the suction pump 64.

The suction unit 62 is provided so that the edge of the suction port faces the image forming area on the surface of the photoreceptor 12, except at either end in the axial direction of the photoreceptor 12, and also distanced from the photoreceptor 12 within a range in which the suction pressure is not lowered excessively, for example.

Additionally, the suction device 60 (namely, the suction pump 64) is electrically connected to the control device 36 provided in the image forming device 10, is driven under control by the control device 36, and at the surface of the photoreceptor 12, suctions all or part of the residual toner (toner particles with adhering external additives) excepting the external additives released from the surface of the toner particles, for example.

Note that, although not illustrated, a collection unit that collects the suctioned residual toner (toner particles with adhering external additives) is joined to the suction pump 64.

Herein, from the perspective of suctioning all or part of the residual toner excepting the external additives released from the surface of the toner particles (in other words, suctioning all or part of the toner particles with adhering external additives while leaving the external additives released from the toner particles on the surface of the photoreceptor 12), the suction pressure of the suction device 60 is preferably from 20 kPa to 40 kPa, and more preferably from 25 kPa to 35 kPa.

Note that the suction pressure is a value measured according to the method indicated below. Namely, the pressure of suction is measured with a vacuum pressure gauge, and the pressure per unit area is calculated from the area of the suction port. This pressure per unit area is taken to be the suction pressure.

(Cleaning Device)

The cleaning device 22 is provided downstream from the transfer area 32A in the rotational direction of the photoreceptor 12. The cleaning device 22 cleans off residual toner adhering to the photoreceptor 12 after the toner image is transferred to the recording medium 30A. The cleaning device 22 also cleans off other adhering substances besides residual toner, such as paper debris.

The cleaning device 22 is blade-type device including a blade 220 that contacts the surface of the photoreceptor 12 and cleans off residual toner.

(Charge Neutralizing Device)

The charge neutralizing device 24 is provided downstream from the cleaning device 22 in the rotational direction of the photoreceptor 12, for example. The charge neutralizing device 24 exposes the surface of the photoreceptor 12 to light to neutralize charge after the toner image is transferred. Specifically, for example, the charge neutralizing device 24 is electrically connected to the control device 36 provided in the image forming device 10, is driven under control by the control device 36, and exposes the entire surface of the photoreceptor 12 to light (specifically, the entire face of the image forming area, for example) to neutralize charge.

The charge neutralizing device 24 may be a device including a light source such as a tungsten lamp that radiates white light, or a light-emitting diode (LED) that radiates red light, for example.

(Fixing Device)

The fixing device 26 is provided downstream from the transfer area 32A in the transport direction of the transport path 34 of the recording medium 30A, for example. The fixing device 26 fixes the toner image transferred onto the recording medium 30A, for example. Specifically, for example, the fixing device 26 is electrically connected to the control device 36 provided in the image forming device 10, is driven under control by the control device 36, and fixes to the recording medium 30A the toner image transferred onto the recording medium 30A by heat, or by heat and pressure.

The fixing device 26 may be a commonly known fuser, such as a roller fuser or an oven fuser, for example.

Herein, after the recording medium 30A is transported along the transport path 34 and passes through the area where the photoreceptor 12 and the transfer member 20 face each other (the transfer area 32A), thereby causing the toner image to be transferred onto the recording medium 30A, the recording medium 30A is transported farther along the transport path 34 by a transport member omitted from illustration, arrives at the position where the fixing device 26 is disposed, and the toner image on the recording medium 30A is fixed, for example.

The recording medium 30A having an image formed thereon by the fixing of the toner image is delivered outside the image forming device 10 by multiple transport members omitted from illustration. Note that the photoreceptor 12, after being neutralized by the charge neutralizing device 24, is once again charged to a charge potential by the charging device 15.

(Control Device)

Figure 2:
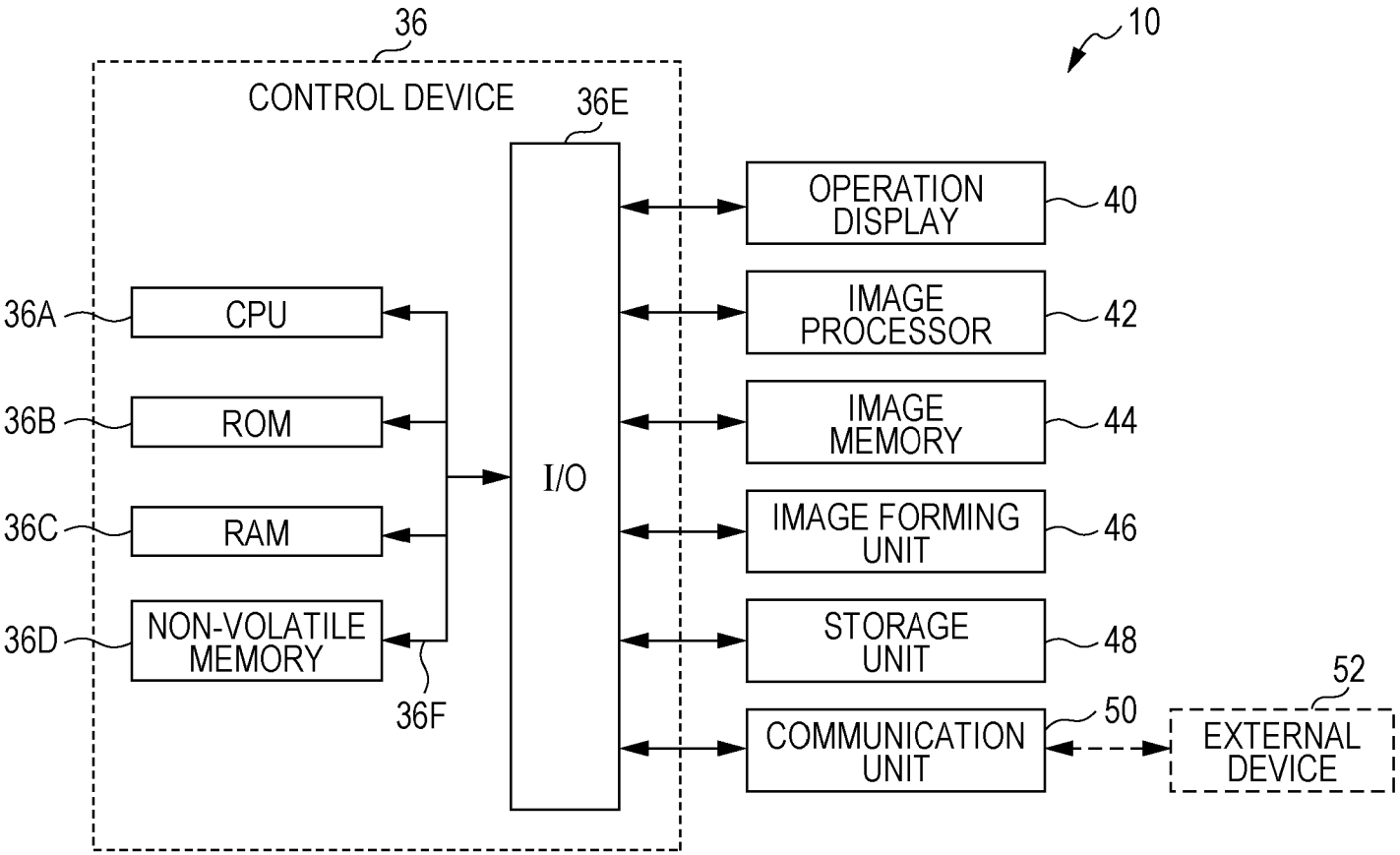
FIG. 2 is a block diagram illustrating an example of a control system in an image forming device according to an exemplary embodiment.

The control device 36 is realized as a computer that controls the overall image forming device and performs various computations. Specifically, as illustrated in FIG. 2, the control device 36 is equipped with a central processing unit (CPU) 36A, read-only memory (ROM) 36B that stores various programs, random access memory (RAM) 36C used as a work area during program execution, non-volatile memory 36D that stores various information, and an input/ output interface (I/O) 36E. The CPU 36A, the ROM 36B, the RAM 36C, the non-volatile memory 36D, and the I/O 36E are connected to each other via a bus 36F.

Additionally, besides the control device 36, the image forming device 10 is equipped with an operation display 40, an image processor 42, image memory 44, an image forming unit 46, a storage unit 48, and a communication unit 50. Each of the operation display 40, the image processor 42, the image memory 44, the image forming unit 46, the storage unit 48, and the communication unit 50 is connected to the I/O 36E of the control device 36. The control device 36 exchanges information with and controls each of the operation display 40, the image processor 42, the image memory 44, the image forming unit 46, the storage unit 48, and the communication unit 50.

The operation display 40 may include various buttons such as a Start button and a keypad, and a touch panel for displaying various screens such as warning screens and settings screens. With the above configuration, the operation display 40 receives operations from a user, and also presents various information to the user.

The image processor 42 performs predetermined image processing on image information acquired from an external device 52 via the communication unit 50, and generates image information for output to the image forming unit 46. For example, PDL data stated in a page description language is processed and converted into raster data laid out in individual RGB colors (RGB data), and a color conversion process is performed on the RGB data to generate data such as YMCK data expressed in colors reproduced by the image forming device. Additionally, processes such as screen processing and gamma correction may also be conducted.

The image memory 44 stores various image information acquired by the image forming device 10, such as image information acquired from the external device 52, and image information generated by the image processor 42. The image memory 44 at least stores image information that has been processed by the image processor 42, or in other words, image information for output to the image forming unit 46, for example.

The image forming unit 46 has been described as the major configuration of the image forming device 10. The image forming unit 46 includes the photoreceptor 12 (namely the drive unit 27), the charging device 15 (including the power source 28), the latent image forming device 16, the developing device 18 (including the power source 32), the transfer device 31 (including the power source 30), the suction device 60 (namely the suction pump 64), the cleaning device 22, the charge neutralizing device 24, and the fixing device 26. Each of the photoreceptor 12 (namely the drive unit 27), the charging device 15, the latent image forming device 16, the developing device 18, the transfer device 31, the suction device 60 (namely the suction pump 64), the charge neutralizing device 24, and the fixing device 26 is connected to the control device 36. The control device 36 exchanges information with and controls each of the above components.

The storage unit 48 is equipped with a storage device such as a hard disk. The storage unit 48 stores various data, such as log data, and various programs.

The communication unit 50 is an interface for communicating with the external device 52 over a wired or a wireless communication link. For example, the communication unit 50 acquires image forming instructions and image information for an electronic document as well as image forming information from the external device 52. The image forming information includes parameters expressing attributes such as the number of pages, the number of copies, and the color mode.

Note that various drives may also be connected to the control device 36. The various drives may include apparatus that read data from and write data to a computer-readable, portable recording medium, such as a flexible disk, a magneto-optical disc, a CD-ROM, a DVD-ROM, or USB memory. In the case of providing various drives, a control program may be prerecorded onto a portable recording medium, read out with a corresponding drive, and executed.

(Operations of Image Forming Device)

An example of the operations of the image forming device 10 according to the present exemplary embodiment will be described. Note that the various operations of the image forming device 10 are conducted according to a control program executed in the control device 36.

Herein, in the image forming device 10, control programs for an "image forming process" and a "residual toner suction process" are stored in advance in the ROM 36B, for example. The control programs stored in advance are read out by the CPU 36A and executed using the RAM 36C as a work area. In addition, in the image forming device 10, various data, such as a "range of area coverage of toner image over which to drive the suction device 60", a "range of area coverage of toner image over which to stop the suction device 60", and "image forming conditions (various process control values)", are stored in advance in the non-volatile memory 36D, for example. These control programs and various data may be stored in the ROM 36B, the non-volatile memory 36D, or another storage device such as the storage unit 48, or be acquired from an external source via the communication unit 50.

First, image forming operations of the image forming device 10 will be described. Image forming operations are conducted according to the control program for the "image forming process" executed in the control device 36.

First, the surface of the photoreceptor 12 is charged by the charging device 15. The latent image forming device 16 exposes the charged surface of the photoreceptor 12 based on image information. Consequently, an electrostatic image corresponding to the image information is formed on the photoreceptor 12. In the developing device 18, the electrostatic image formed on the surface of the photoreceptor 12 is developed by developer including toner. Consequently, a toner image is formed on the surface of the photoreceptor 12. In the transfer device 31, the toner image formed on the surface of the photoreceptor 12 is transferred to the recording medium 30A. The toner image transferred to the recording medium 30A is fixed by the fixing device 26. Meanwhile, after the toner image is transferred, the surface of the photoreceptor 12 is cleaned by the cleaning device 22, and neutralized by the charge neutralizing device 24.

Meanwhile, in the image forming device 10, while the image forming operations are being executed, the control device 36 controls the suction device 60 so as to start the suction of residual toner by the suction device 60 when the area coverage of the toner image is equal to or greater than a predetermined value, and stop the suction of residual toner by the suction device 60 when the area coverage of the toner image is less than a predetermined value ("residual toner suction operation by the suction device 60").

The residual toner suction operation by the suction device 60 will now be described. The residual toner suction operation by the suction device 60 is conducted according to the control program for the "residual toner suction process" executed in the control device 36. The control program for the "residual toner suction process" is started when image forming instructions or the like are received from the operation display 40 or from the external device 52 via the communication unit 50, for example.

Figure 3:
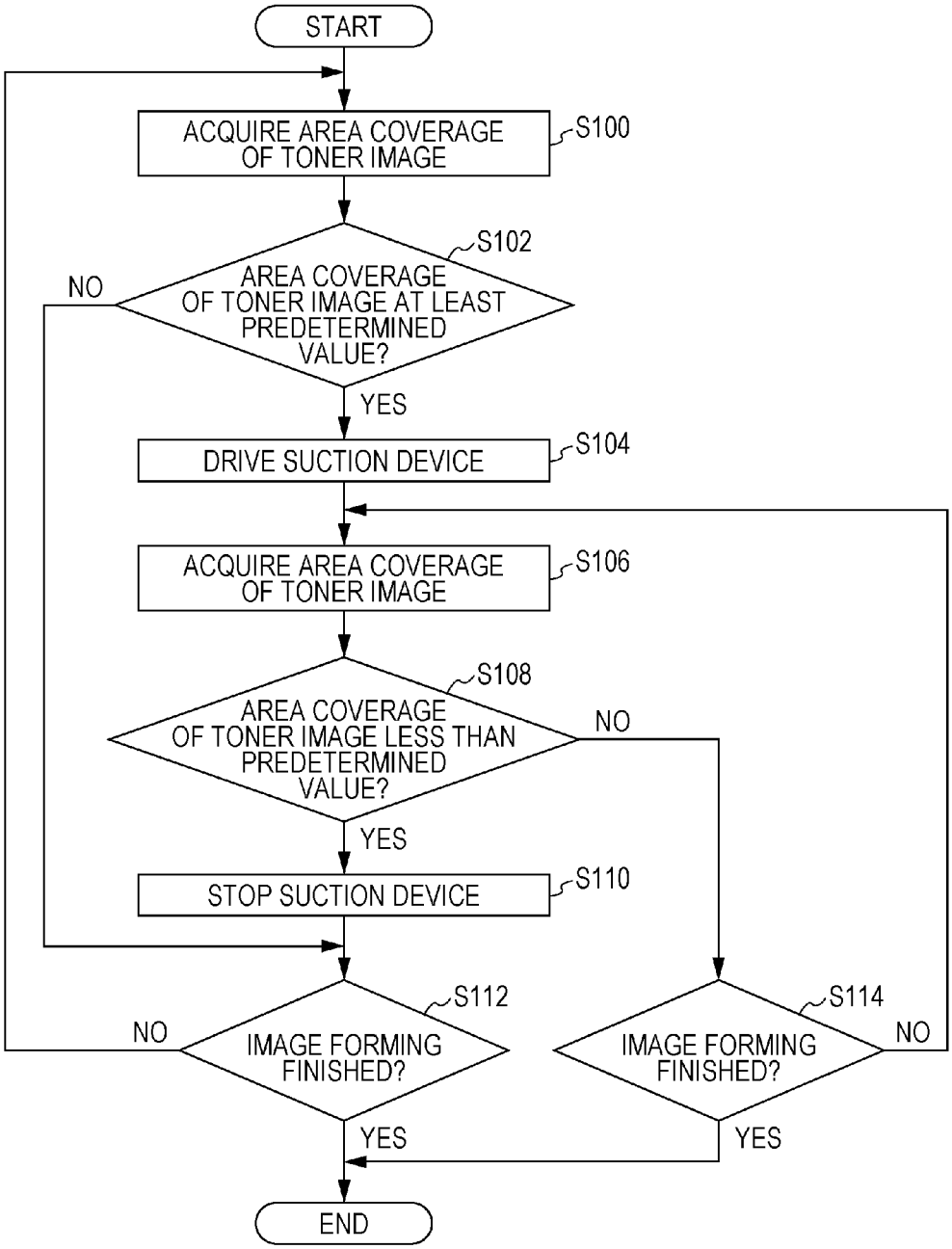
FIG. 3 is a flowchart illustrating an example of a processing sequence of a residual toner suction process.

First, as illustrated in FIG. 3, in step S100, the area coverage of the toner image is acquired.

The method of acquiring the area coverage is not particularly limited, and may be a method of acquiring the area coverage computed based on image data scanned by an image reading device (not illustrated) that scans the toner images formed on the recording medium 30A, or a method of acquiring the area coverage computed based on the image information of the image to form, for example.

Next, in step S102, it is determined whether or not the acquired area coverage of the toner image is equal to or greater than a predetermined value.

Specifically, for example, the "range of area coverage of toner image over which to drive the suction device 60" stored in advance in the non-volatile memory 36D is acquired, and this range of area coverage of the toner image is compared to the acquired area coverage of the toner image.

Note that the "range of area coverage of toner image over which to drive the suction device 60" is a range obtained by experimentally finding a relationship between the area coverage of the toner image and the slip-through rate of toner slipping through the worn areas of the blade 220, and creating a range of area coverage of the toner image from this relationship. In other words, the "range of area coverage of toner image over which to drive the suction device 60" is the range of area coverage of the toner image in which the slip-through rate of toner slipping through the worn areas of the blade 220 becomes excessive and exceeds a target range, for example.

If the determination in step S102 is negative (that is, if the acquired area coverage of the toner image is less than the predetermined value, or in other words, if the acquired area coverage of the toner image is determined to be outside the range of area coverage of the toner image over which to drive the suction device 60), the flow proceeds to step S112.

On the other hand, if the determination in step S102 is positive (that is, if the acquired area coverage of the toner image is equal to or greater than the predetermined value, or in other words, if the acquired area coverage of the toner image is determined to be inside the range of area coverage of the toner image over which to drive the suction device 60), the flow proceeds to step S104.

Next, in step S104, the suction device 60 (namely the suction pump 64) is driven to suction all or part of the residual toner excepting the external additives released from the surface of the toner particles (in other words, all or part of the toner particles with the external additives adhering to the surface thereof are suctioned, while leaving the external additives released from the toner particles on the surface of the photoreceptor 12). Consequently, the amount of residual toner (toner particles with adhering external additives) arriving at the cleaning area (the area of contact between the blade 220 and the photoreceptor 12) is moderated, and thus even if the blade is worn, the slipping through of toner from the worn areas of the blade is moderated.

Next, in step S106, the area coverage of the toner image is acquired.

Next, in step S108, it is determined whether or not the acquired area coverage of the toner image is less than a predetermined value.

Specifically, for example, the "range of area coverage of toner image over which to stop the suction device 60" stored in advance in the non-volatile memory 36D is acquired, and this range of area coverage of the toner image is compared to the acquired area coverage of the toner image.

Note that the "range of area coverage of toner image over which to stop the suction device 60" is a range obtained by experimentally finding a relationship between the area coverage of the toner image and the amount of slip-through of toner slipping through the worn areas of the blade 220, and creating a range of area coverage of the toner image from this relationship. In other words, the "range of area coverage of toner image over which to stop the suction device 60" is the range of area coverage of the toner image in which there is no slip-through of toner slipping through the worn areas of the blade 220 or in which the slip-through rate of toner is small and remains inside a target range, for example.

If the determination in step S108 is negative (that is, if the acquired area coverage of the toner image is equal to or greater than the predetermined value, or in other words, if the acquired area coverage of the toner image is determined to be outside the range of area coverage of the toner image over which to stop the suction device 60), the flow proceeds to step S114.

On the other hand, if the determination in step S108 is positive (that is, if the acquired area coverage of the toner image is less than the predetermined value, or in other words, if the acquired area coverage of the toner image is determined to be inside the range of area coverage of the toner image over which to stop the suction device 60), the flow proceeds to step S110.

Next, in step S110, the driving of the suction device 60 (namely the suction pump 64) is stopped. Consequently, even if the amount of external additives released from the toner particles is small, toner particles with the external additives adhering to the surface thereof are made to arrive at the cleaning part to an extent that the slipping through of toner is still moderated, the external additives are released from the toner particles by mechanical load due to scraping at the cleaning part or the like, and the magnitude of the additive dam is increased. As a result, for this reason, decreases in cleaning performance are moderated, while in addition, the slipping through of toner from the worn areas of the blade is moderated.

At this point, in step S112, it is determined whether or not the image forming operations are finished. If it is determined in step S112 that the image forming operations are not finished, the flow returns to step S100. On the other hand, if it is determined in step S112 that the image forming operations are finished, the routine ends.

Meanwhile, in step S114, it is determined likewise whether or not the image forming operations are finished. If it is determined in step S114 that the image forming operations are not finished, the flow returns to step S106. On the other hand, if it is determined in step S114 that the image forming operations are finished, the routine ends.

In the image forming device 10 according to the present exemplary embodiment described above, the suction device 10 suctions all or part of the residual toner excepting the external additives released from the surface of the toner particles (in other words, suctions toner particles with the external additives adhering to the surface thereof, while leaving the external additives released from the toner particles on the surface of the image carrier). Consequently, the amount of residual toner (amount of toner particles) arriving at the cleaning part is moderated, and thus even if the blade becomes worn, the slipping through of toner from the worn areas of the blade is itself moderated. On the other hand, the external additives released from the toner particles arrive at the cleaning part and contribute to the formation of an additive dam, thereby ensuring cleaning ability.

In addition, the control device 36 controls the suction device 60 based on the area coverage of the toner image, and starts or stops the suction of residual toner by the suction device 60. Consequently, when the area coverage is low and the slipping through of toner occurs less readily (when the area coverage is less than a predetermined value), the suction of residual toner by the suction device 60 is stopped, the amount of toner particles with the external additives adhering to the surface thereof arriving at the cleaning part, or in other words, the magnitude of the additive dam, may be increased. For this reason, decreases in cleaning performance are moderated, while in addition, the slipping through of toner from the worn areas of the blade is moderated.

Herein, in the image forming device 10 according to the present exemplary embodiment, the "residual toner suction process" is not limited to the above-described, and the following residual toner suction process (hereinafter designated the "other residual toner suction process") may also be performed, for example.

Note that in this case, in the image forming device 10, a control program for the "other residual toner suction process" is stored in advance in the ROM 36B, and a "suction pressure information table for the suction device 60" is stored in advance in the non-volatile memory 36D, for example. These control programs and various data may be stored in the ROM 36B, the non-volatile memory 36D, or another storage device such as the storage unit 48, or be acquired from an external source via the communication unit 50.

Figure 4:
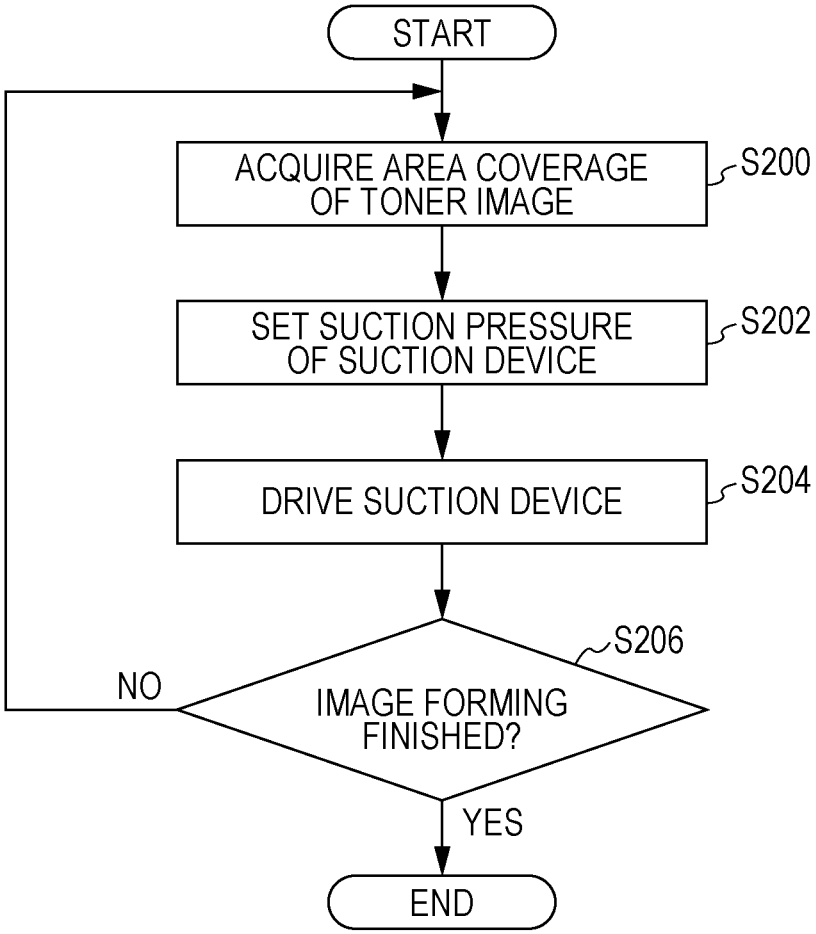
FIG. 4 is a flowchart illustrating another example of a processing sequence of a residual toner suction process.

In the "other residual toner suction process", first, as illustrated in FIG. 4, in step S100, the area coverage of the toner image is acquired.

Next, in step S202, the suction pressure of the suction device 60 is set. Subsequently, the flow proceeds to step S204.

Specifically, in step S202, a suction pressure information table for the suction device 60 is read out, and suction pressure information for the suction device 60 is acquired from the suction pressure information table for the suction device 60, based on the area coverage of the toner image. Subsequently, the suction pressure of the suction device 60 is set based on the suction pressure information for the suction device 60.

Herein, the suction pressure information table for the suction device 60 is a table associating the area coverage of the toner image with the suction pressure of the suction device 60, for example. In other words, the suction pressure information table for the suction device 60 is a table that sets the suction pressure of the suction device 60 (that is, the degree to which to suction residual toner) according to the area coverage of the toner image.

The suction pressure information table of the suction device 60 is created so that when the area coverage of the toner image is high, a high suction pressure of the suction device 60 is set, whereas when the area coverage of the toner image is low, a low suction pressure of the suction device 60 is set, for example. Specifically, the suction pressure information table of the suction device 60 is created based on factors such as the relationship between the area coverage of the toner image and the slip-through rate of toner slipping through the worn areas of the blade 220, and the relationship between the suction pressure of the suction device 60 and the amount of suctioned residual toner.

Next, in step S204, the suction device 60 is driven. Specifically, the suction device 60 is driven at the set suction pressure of the suction device 60. Subsequently, the flow proceeds to step S206.

Next, in step S206, it is determined whether or not the image forming operations are finished. If it is determined in step S206 that the image forming operations are not finished, the flow returns to step S200. On the other hand, if it is determined in step S206 that the image forming operations are finished, the routine ends.

In the "other residual toner suction process" described above, the control device 36 controls the suction device 60 based on the area coverage of the toner image, and changes the suction pressure of the suction device. Consequently, when the area coverage of the toner image is high and the slipping through of toner occurs more readily (when the area coverage is equal to or greater than a predetermined value), the suction pressure of the suction device is raised and the amount of suctioned toner particles with adhering external additives is increased, whereas when the area coverage is low and the slipping through of toner occurs less readily (when the area coverage is less than a predetermined value), the suction pressure of the suction device is lowered and the amount of suctioned toner particles with adhering external additives is decreased. Thus, the amount of toner particles with external additives adhering to the surface thereof arriving at the cleaning area, or in other words, the magnitude of the additive dam, is ensured. For this reason, decreases in cleaning performance are moderated, while in addition, the slipping through of toner from the worn areas of the blade is moderated.

Test Example

Hereinafter, a test example will be illustrated in which, in the image forming device 10 according to the present exemplary embodiment, the suction pressure of the suction device is set from 20 kPa to 40 kPa, thereby suctioning all or part of the residual toner excepting the external additives released from the surface of the toner particles (in other words, suctioning toner particles with the external additives adhering to the surface thereof, while leaving the external additives released from the toner particles on the surface of the image carrier). This test example substantiates the easier realization of total removal of such toner particles from the surface of the image carrier (or partial removal that decreases the amount of residual toner).

Test Example

A Fuji Xerox DOCUCENTRE-V C7775 was made to print 1500 copies of an image with 25% area coverage. When a suction process was not conducted after transfer, toner slip-through occurred. When a suction process at 25 kPa/$m^2$ was conducted after transfer, the absence of toner slip-through was confirmed.

The above result thus demonstrates that by setting the suction pressure of the suction device from 20 kPa to 40 kPa, all or part of the residual toner excepting the external additives released from the surface of the toner particles is suctioned (in other words, toner particles with the external additives adhering to the surface thereof are suctioned, while leaving the external additives released from the toner particles on the surface of the image carrier), thereby substantiating the easier realization of total removal of such toner particles from the surface of the image carrier (or partial removal that decreases the amount of residual toner).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device, comprising:

an image carrier;

a charging device that charges a surface of the image carrier;

an electrostatic image forming device that forms an electrostatic image on the surface of the image carrier;

a developing device that includes electrostatic image developer including toner that contains toner particles and external additives adhering to a surface of the toner particle, and uses the electrostatic image developer to develop the electrostatic image formed on the surface of the image carrier into a toner image;

a transfer device that transfers the toner image formed on the surface of the image carrier onto a surface of a recording medium;

a cleaning device having a blade that contacts the surface of the image carrier and cleans off residual toner;

a suction device, located upstream of the cleaning device in a rotational direction of the image carrier, that suctions all or part of residual toner except the external additives released from the surface of the toner particles, by utilizing a predetermined range of suction pressure; and a fixing device that fixes the toner image transferred to the surface of the recording medium.

2. The image forming device according to claim 1, wherein the suction pressure of the suction device ranges from −20 kPa to −40 kPa.

3. The image forming device according to claim 1, further comprising:

a control device that controls the suction device based on an area coverage of the toner image, and starts or stops the suction of residual toner by the suction device.

4. The image forming device according to claim 1, further comprising:

a control device that controls the suction device based on an area coverage of the toner image, and changes the suction pressure of the suction device.

5. The image forming device according to claim 1, wherein a volume mean diameter of the toner particles ranges from 3 μm to 5 μm.

6. The image forming device according to claim 1, wherein a mean degree of circularity of the toner particles ranges from 0.95 to 1.00.

7. The image forming device according to claim 1, wherein the suction pressure of the suction device ranges from −25 kPa to −35 kPa.

8. The image forming device according to claim 1, wherein a mean degree of circularity of the toner particles ranges from 0.98 to 1.00.

* * * * *